US007802378B2

(12) United States Patent
Harmon Weiss et al.

(10) Patent No.: US 7,802,378 B2
(45) Date of Patent: Sep. 28, 2010

(54) INSERT FOR ARTICLE OF FOOTWEAR AND METHOD FOR PRODUCING THE INSERT

(75) Inventors: Edith Harmon Weiss, Swampscott, MA (US); Patrick Yinhkee Choe, Cambridge, MA (US); Sean Brendon Murphy, North Andover, MA (US)

(73) Assignee: New Balance Athletic Shoe, Inc., Boston, MA (US)

( * ) Notice: Subject to any disclaimer, the term of this patent is extended or adjusted under 35 U.S.C. 154(b) by 751 days.

(21) Appl. No.: 11/057,543

(22) Filed: Feb. 14, 2005

(65) Prior Publication Data

US 2006/0179683 A1 Aug. 17, 2006

(51) Int. Cl.
*A43B 12/28* (2006.01)
*A43B 13/18* (2006.01)

(52) U.S. Cl. ..... 36/28; 36/35 R; 36/27

(58) Field of Classification Search ..... 36/28, 36/35 R, 25 R, 34 R, 27
See application file for complete search history.

(56) References Cited

U.S. PATENT DOCUMENTS

| | | | | |
|---|---|---|---|---|
| 3,253,355 | A | 5/1966 | Menken | |
| 3,742,622 | A | 7/1973 | Dassler | |
| 4,336,661 | A | 6/1982 | Medrano | |
| 4,571,853 | A | 2/1986 | Medrano | |
| 4,590,689 | A | 5/1986 | Rosenberg | |
| 4,700,403 | A | 10/1987 | Vacanti | |
| 4,874,640 | A | 10/1989 | Donzis | |
| 5,092,060 | A | 3/1992 | Frachey et al. | |
| 5,235,715 | A | 8/1993 | Donzis | |
| 5,343,639 | A | 9/1994 | Kilgore et al. | |
| 5,353,523 | A | 10/1994 | Kilgore et al. | |
| 5,363,570 | A | 11/1994 | Allen et al. | |
| 5,369,896 | A | 12/1994 | Frachey et al. | |
| 5,741,568 | A | 4/1998 | Rudy | |
| 5,918,383 | A | 7/1999 | Chee | |
| 5,930,918 | A | 8/1999 | Healy et al. | |
| 5,979,078 | A | 11/1999 | McLaughlin | |
| 5,987,780 | A | 11/1999 | Lyden et al. | |
| 5,996,253 | A | 12/1999 | Spector | |
| 6,487,796 | B1 * | 12/2002 | Avar et al. | 36/28 |
| 6,568,102 | B1 * | 5/2003 | Healy et al. | 36/28 |
| 2002/0121031 | A1 * | 9/2002 | Smith et al. | 36/29 |
| 2003/0208929 | A1 * | 11/2003 | Lucas et al. | 36/28 |
| 2005/0028403 | A1 * | 2/2005 | Swigart et al. | 36/28 |

FOREIGN PATENT DOCUMENTS

| | | |
|---|---|---|
| TW | 406535 | 9/2000 |
| WO | WO 99/38403 | 8/1999 |
| WO | WO 03/056964 A1 | 7/2003 |

OTHER PUBLICATIONS

PCT/US04/03051 International Search Report Jul. 17, 2003.

* cited by examiner

*Primary Examiner*—Jila M Mohandesi

(57) ABSTRACT

An insert for footwear which has improved durability and pliability and satisfies a thumb test of pliability when exposed along the sides of the footwear. The insert comprises a compressible core at least partially surrounded by a flexible casing. The flexible casing has an open window of a size which is sufficient for insertion of the compressible core into the flexible casing but leaving sufficient material to hold the compressible core. The peripheral portion of the flexible casing is spaced from at least a portion of the peripheral surface of the compressible core, while not interfering with the foot applying pressure to the compressible core. A method for making the insert is also provided.

42 Claims, 10 Drawing Sheets

INSERT FOR ARTICLE OF FOOTWEAR AND METHOD FOR PRODUCING THE INSERT

BACKGROUND OF THE INVENTION

The feet of an individual are subject to substantial impact forces during regular activities such as standing and walking. The impact forces are particularly strong during athletic activities such as running and jumping. Footwear which provides proper cushioning and support may prevent the feet from discomfort, soreness, fatigue and injury caused by such impact forces.

Numerous cushioning elements or inserts used in footwear to cushion a wear's foot have been developed over the years to absorb the impact forces. Many of such cushioning elements or inserts are made at least partially of compressible materials. For example, foam materials such as ethylene vinyl acetate (EVA) and polyurethane (PU) have been widely used in the footwear industry to form part of a sole, due to its advantageous properties such as light weight and isotropic cushioning property.

U.S. Pat. Nos. 5,092,060 and 5,369,896 to Frachey et al. disclose a sports shoe having an insert which includes a plurality of barrel-shaped elements that are elastically deformable under pressure and are enclosed in an airtight casing of a plastic material. The insert is arranged in a seat provided in a wedge in a position corresponding with the heel of the foot and is confined by the surrounding wall portion of the seat. However, the plurality of barrel-shaped elements may cause individual pressure points above each element, resulting in uneven pressure distribution. Furthermore, if a customer presses a side of the shoe by a thumb to check the pliability or elasticity of the shoe sole, which often happens in the process of selecting a pair of shoes to buy, the shoe may not satisfy the thumb test because it does not feel soft or pliable peripherally.

U.S. Pat. Nos. 4,874,640 and 5,235,715 to Donzis disclose a composite for absorbing and dispersing impacting forces. The composite includes a flexible plastic enclosure defining an internal cavity. The flexible enclosure is generally impermeable to air and capable of having its internal pressure changed. The composite further includes a foam core filling the cavity and retained within the cavity and adhered on substantially its entire external surface to the internal surface of the cavity. The cavity can be pressurized for higher impact absorbance. The method for producing the composites includes forming the outer enclosure by applying a solution/suspension of the prepolymer of controlled solids content to the core and also can include the step of preheating the core prior to coating it. To withstand the high inflation pressures in such air bladders, the foam core must be of a high strength which requires the use of a higher density foam. The higher the density of the foam, the less the air space available in the bladder. Consequently, the reduction in the amount of air in the bladder decreases the cushioning benefits provided by air. Furthermore, air bladders relying on elevated internal pressures to cushion are susceptible to punctures and leakage.

U.S. Pat. Nos. 5,343,639 and 5,353,523 to Kilgore et al. disclose a midsole for a shoe including one or more foam columns disposed between an upper and a lower plate. The foam columns may include grooves formed on the exterior surface. One or more elastic rings are disposed about the columns and are removably disposable in the grooves, allowing the stiffness of the columns to be adjusted. In a further embodiment, inflatable gas bladders are disposed in the hollow regions. The structure and manufacture of such midsoles are very complicated.

As described above, all of these constructions are not completely satisfactory. Furthermore, compressible materials such as foam in shoe soles tend to break down over time, especially notably when the shoe soles are frequently subject to abrasions and exposed to excessive heat and moisture, resulting in discoloration and mushy appearance of the soles, which are not only aesthetically undesirable, but also may affect their shock absorbing capacity. Therefore, there remains a need for a cushioning insert for footwear that has improved durability and pliability, while keeping all the advantageous properties of compressible materials and eliminating the drawbacks of the above described constructions.

SUMMARY OF THE INVENTION

It is an object of the present invention to provide an insert for footwear which properly cushions and supports a region of a foot and is durable and easy to manufacture.

It is another object of the present invention to provide an insert for footwear which when incorporated into an article of footwear, is aesthetically desirable and satisfies a thumb test of pliability.

In accordance with an aspect of the present invention, there is provided an insert for an article of footwear, comprising: a compressible core allowing pressure to be applied thereon by a foot, the compressible core having a top surface, a bottom surface and a peripheral surface; and a flexible casing for surrounding at least a portion of the compressible core, the flexible casing having a top portion, a bottom portion and a peripheral portion, the flexible casing having an open window, the window having a size which is sufficient for insertion of the compressible core into the flexible casing but leaving sufficient material to hold the compressible core, the peripheral portion of the flexible casing being spaced from at least a portion of the peripheral surface of the compressible core, while not interfering with the foot applying pressure to the compressible core.

In accordance with another aspect of the present invention, there is provided an insert for an article of footwear, comprising: a compressible core, the compressible core having a top surface, a bottom surface and a peripheral surface; and a flexible casing for surrounding at least a portion of the compressible core, the flexible casing having a top portion, a bottom portion and a peripheral portion, the flexible casing having an open window, the window having a size which is sufficient for insertion of the compressible core into the flexible casing but leaving sufficient material to hold the compressible core, the peripheral portion of the flexible casing being spaced from at least a portion of the peripheral surface of the compressible core, while not interfering with the foot applying pressure to the compressible core; wherein the insert has a first compressibility at its top or bottom surface and a second compressibility at its peripheral surface, the second compressibility being greater than the first compressibility preferably by at least about 10%, for example about 10-40%, more preferably by at least 20%, for example about 20-50%, and most preferably by at least about 30%, for example about 30-60%.

In accordance with yet another aspect of the present invention, the insert may further comprise a cap for at least partially covering the open window of the flexible casing.

In accordance with a further aspect of the present invention, there is provided an article of footwear, comprising a sole, the sole having a portion formed to receive an insert; and an insert in accordance with the present invention mounted in the portion formed to receive an insert.

In accordance with another aspect of the present invention, there is provided a method of making an insert for an article of footwear, comprising: providing a compressible core, the compressible core having a top surface, a bottom surface and a peripheral surface; forming a flexible casing for surrounding at least a portion of the compressible core, the flexible casing having a top portion, a bottom portion and a peripheral portion, the flexible casing having an open window, the window having a size which is sufficient for insertion of the compressible core into the flexible casing but leaving sufficient material to hold the compressible core; applying an adhesive to a predetermined area of the inner surface of the flexible casing; and bringing the compressible core into contact with the inner surface of the flexible casing.

In accordance with another aspect of the present invention, the method further comprises providing a sheet of flexible material; die cutting a cap from the sheet of flexible material; and sealing the cap to the bonded flexible casing and compressible core to at least partially cover the window of the flexible casing.

In accordance with yet another aspect of the present invention, there is provided a method of making an insert for an article of footwear, comprising: providing a compressible core, the compressible core having a top surface, a bottom surface and a peripheral surface; forming a flexible casing for surrounding at least a portion of the compressible core, the flexible casing having a top portion, a bottom portion and a peripheral portion, the flexible casing having an open window, the window having a size which is sufficient for insertion of the compressible core into the flexible casing but leaving sufficient material to hold the compressible core; turning the flexible casing inside out exposing the inner surface of the flexible casing; applying an adhesive to a predetermined area of the inner surface of the flexible casing; turning the flexible casing back; and bringing the compressible core into contact with the inner surface of the flexible casing.

DETAILED DESCRIPTION OF THE INVENTION

The present invention can be better understood from the following description of preferred embodiments, taken in conjunction with the accompanying drawings. It should be apparent to those skilled in the art that the described embodiments of the present invention provided herein are merely exemplary and illustrative and not limiting. All features disclosed in the description may be replaced by alternative features serving the same or similar purpose, unless expressly stated otherwise. Therefore, numerous other embodiments of the modifications thereof are contemplated as falling within the scope of the present invention and equivalents thereto.

Figure 1:
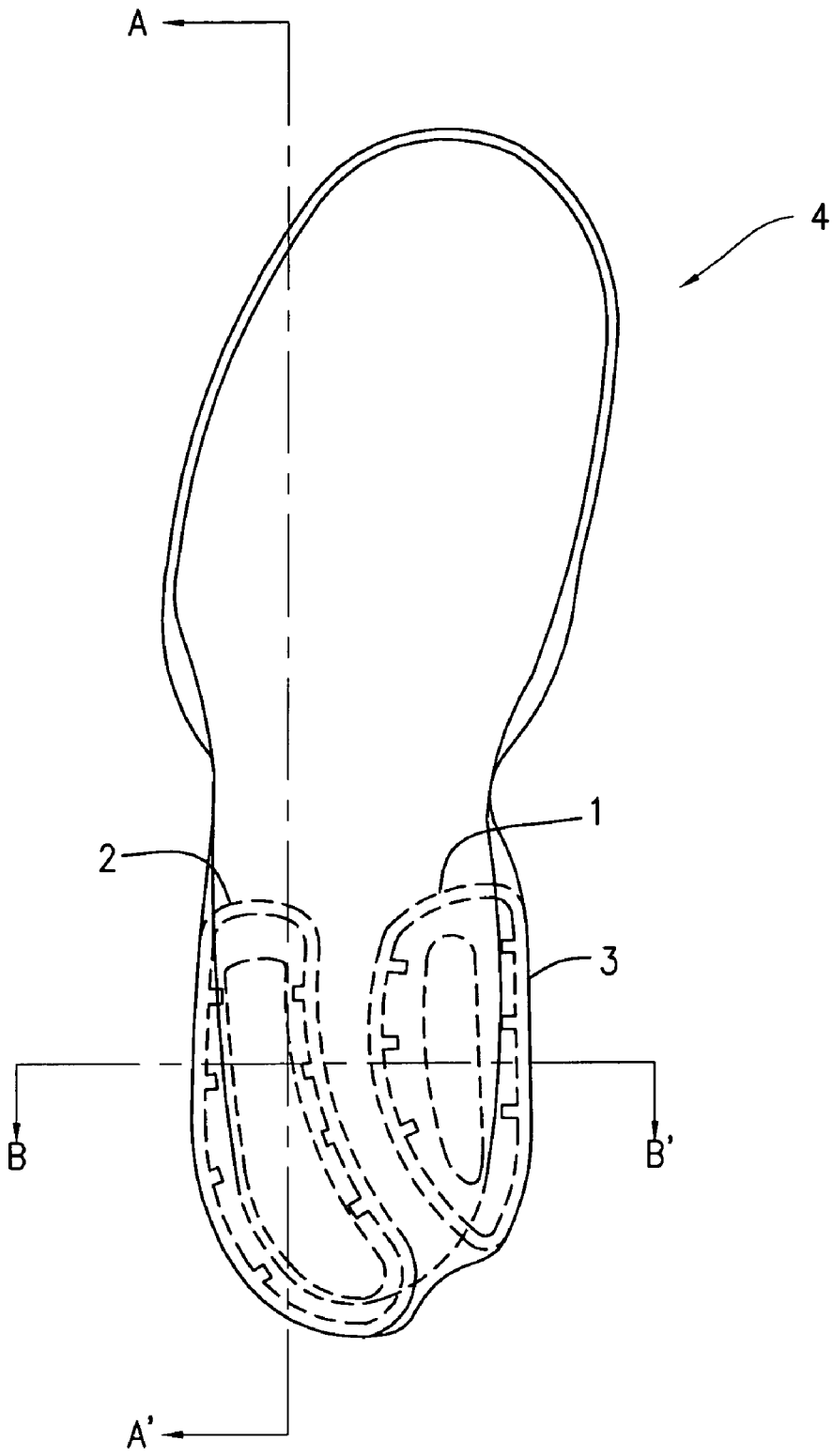
FIG. 1 is a top plan view of a sole which incorporates exemplary inserts in accordance with the present invention.
Figure 2:
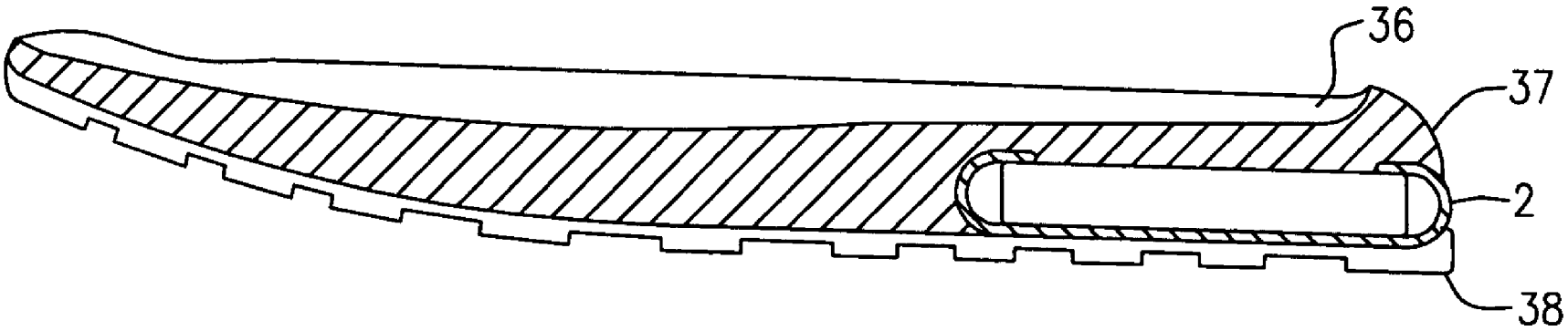
FIG. 2 is a longitudinal section view taken along line A-A' of FIG. 1.
Figure 3:
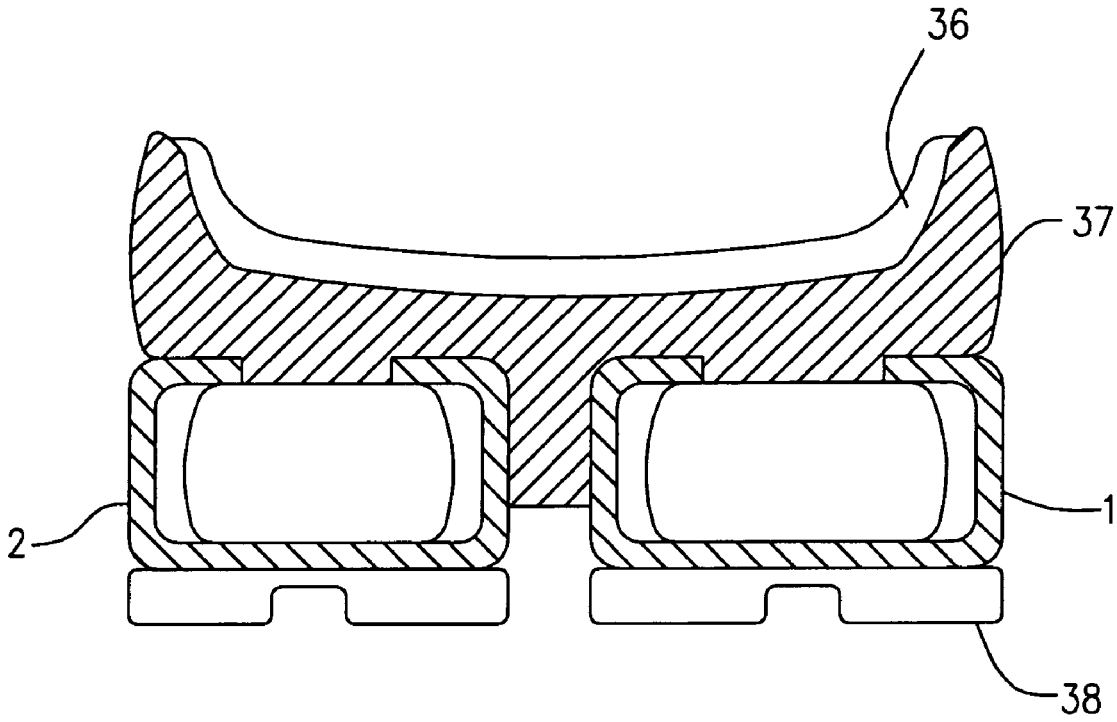
FIG. 3 is a cross section view taken along line B-B' of FIG. 1.

FIGS. 1-3 show an exemplary sole employing a preferred embodiment of a pair of inserts of the present invention in a heel portion 3 of the sole 4. The sole comprises an insole 36, a midsole 37 and an outsole 38. The pair of inserts includes a first insert 1 and a second insert 2. The first insert 1 is of trapezoidal shape and the second insert 2 is of kidney-like shape. The incorporation of two inserts of the particular shapes as shown in FIG. 1 in a sole is preferred for easy arrangement and accommodation to soles of different dimensions. However, a single large insert or more than two inserts that can properly be arranged in any portion of a sole to provide desired cushioning and support for a selected region of the foot are also contemplated. The insert may comprise a variety of shapes to optimally flex with the bend lines of the foot.

Figure 4:
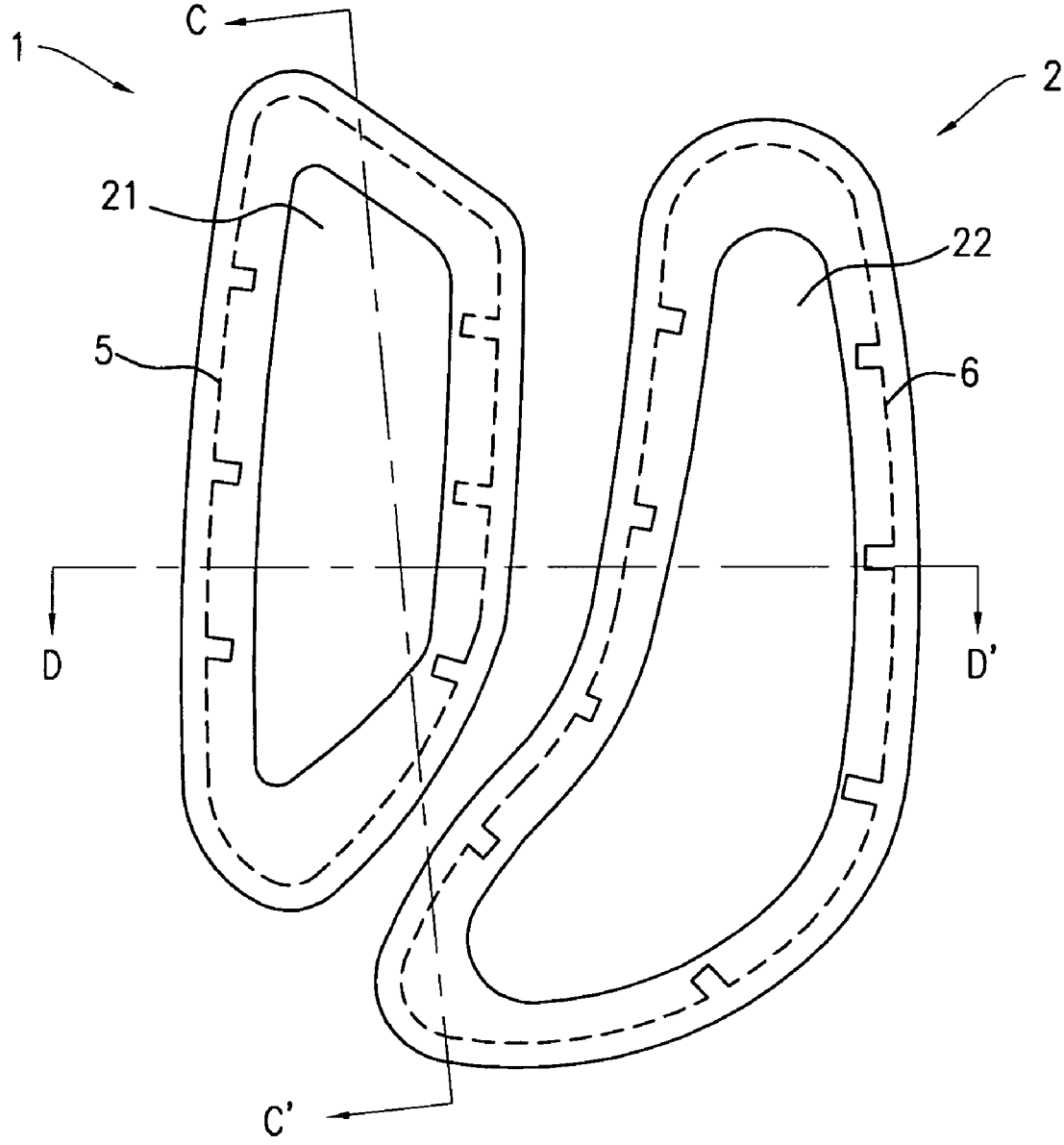
FIG. 4 is a top plan view of exemplary first and second inserts for footwear in accordance with the present invention.
Figure 5:
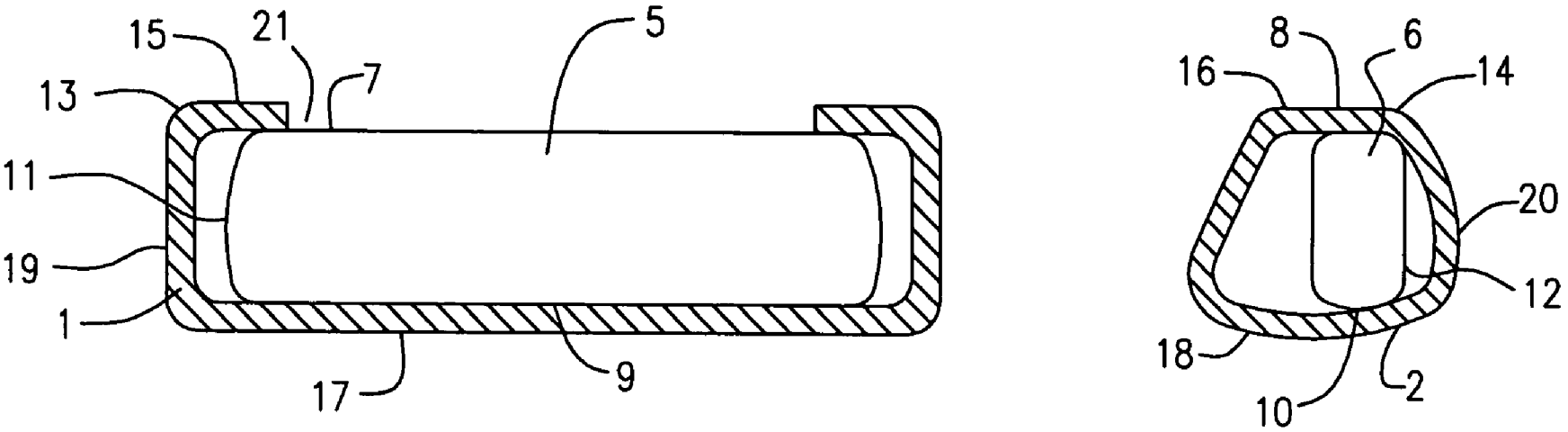
FIG. 5 is a longitudinal section view taken along line C-C' of FIG. 4.
Figure 6:
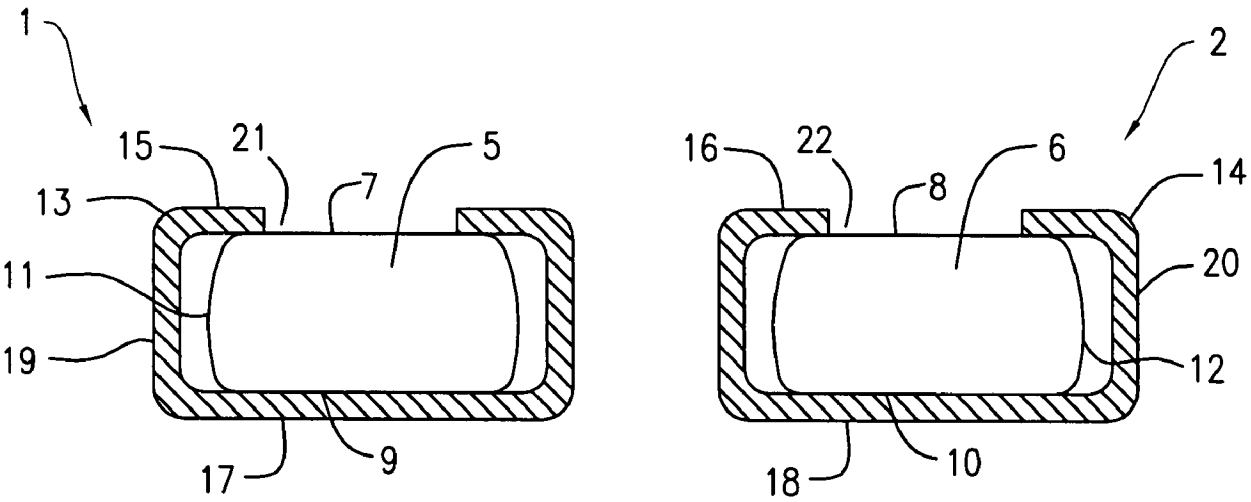
FIG. 6 is a cross section view taken along line D-D' of FIG. 4.

Referring to FIGS. 4-6, the inserts 1, 2 each have a compressible core 5, 6 allowing pressure to be applied thereon by a foot, the compressible core having a top surface 7, 8, a bottom surface 9, 10 and a peripheral surface 11, 12; and a flexible casing 13, 14 for surrounding at least a portion of the compressible core 5, 6, the flexible casing 13, 14 having a top portion 15, 16, a bottom portion 17, 18 and a peripheral portion 19, 20. The flexible casing has an open window 21, 22 in a portion of the top portion 15, 16. Although the window is formed on the top portion of the flexible casing in the preferred embodiment, it is contemplated that the window may be formed on any portion of the flexible casing, for example, on the bottom or peripheral portion of the flexible casing. The open window 21, 22 has a size which is sufficient for insertion of the compressible core 5, 6 into the flexible casing 13, 14 but leaving sufficient material to hold the compressible core 5, 6. The open window can be as small as a slit or a slit-like opening as long as the compressible core or cores can be inserted into the flexible casing through the window. The peripheral portion 19, 20 of the flexible casing 13, 14 is spaced from at least a portion of the peripheral surface 11, 12 of the compressible core 5, 6, while not interfering with the foot applying pressure to the compressible core 5, 6.

The compressible core 5, 6 and the flexible casing 13, 14 may be bonded by an adhesive, for example, along the periphery of the window and/or at at least a portion of the bottom surface of the compressible core. Preferably, if an adhesive is used, it does not interfere with the transparency of the portion of the flexible casing that will be exposed after the insert is incorporated into an article of footwear.

The peripheral portion 19, 20 of the flexible casing 13, 14 is spaced from at least a portion of the peripheral surface 11, 12 of the compressible core 5, 6 by about 1 to 8 mm, preferably by about 1 to 5 mm, and more preferably by about 1 to 3 mm, forming a circumferential air gap between the compressible core 5, 6 and the flexible casing 13, 14. The peripheral portion 19, 20 of the flexible casing 13, 14 may not be uniformly spaced from the peripheral surface 11, 12 of the compressible core 5, 6 along the circumference and may be in contact with the compressible core at some locations.

The material for the compressible core is preferably a foam material or any suitable elastic cushioning material. It may be selected from the following exemplary materials bearing in mind that other suitable materials are also contemplated: ethyl vinyl acetate (EVA) co-polymer, thermo-set polyether and poly-ester urethane, ethyl vinyl acetate co-polymer blends including isoprene rubber, poly-olefins, natural and synthetic rubbers, and blends or combinations thereof. The EVA co-polymer is the preferred material for the compressible core. The compressible core may also be a combination of more than one material, for example, in the form of a laminate.

The material for the flexible casing may be a plastic material or any durable and pliable material. Preferably, the material for the flexible casing is transparent or translucent such that the decorative patterns on the compressive core can be seen through the flexible casing for desired visual effects. It may be selected from the following exemplary materials bearing in mind that other suitable materials are also contemplated: thermoplastic polyurethane (TPU), polyester-TPU, polyether-TPU, polyester-polyether TPU, polyvinylchloride, polyester, thermoplastic ethyl vinyl acetate, styrene butadiene styrene, TPU blends including natural and synthetic rubbers, and blends or combinations thereof. TPU is the preferred material for the flexible casing.

Figure 7:
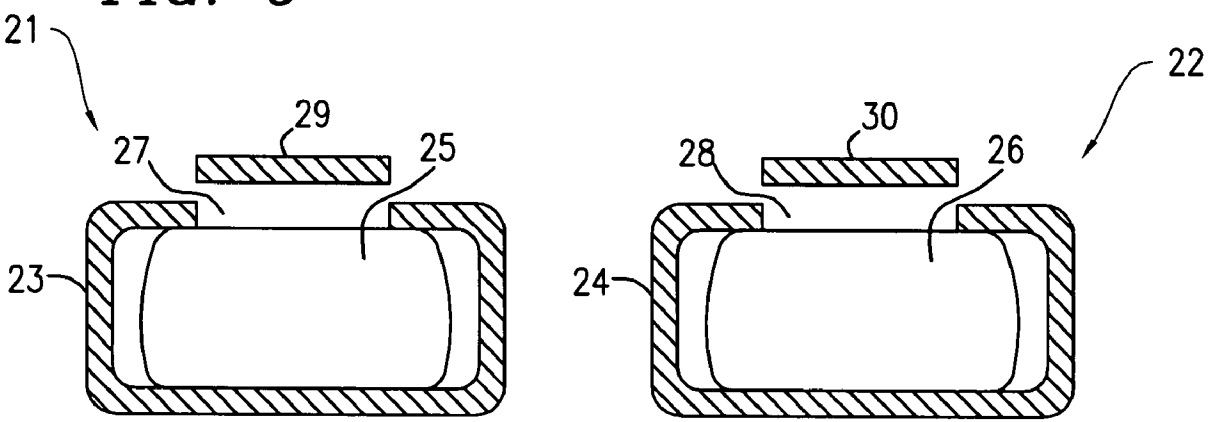
FIG. 7 is a cross section view of another exemplary embodiment of inserts with caps in accordance with the present invention.

FIG. 7 depicts another exemplary embodiment of the present invention. The inserts 21, 22 each have a compressible core 25, 26 and a flexible casing 23, 24 for surrounding at least a portion of the compressible core 25, 26, the flexible casing having an open window 27, 28. The inserts 21, 22 each further include a cap 29, 30 which covers the window 27, 28. In FIG. 7, the caps 29, 30 are disassociated with the inserts 21, 22 for better illustration. The cap at least partially, and preferably completely, covers the window.

Figure 8:
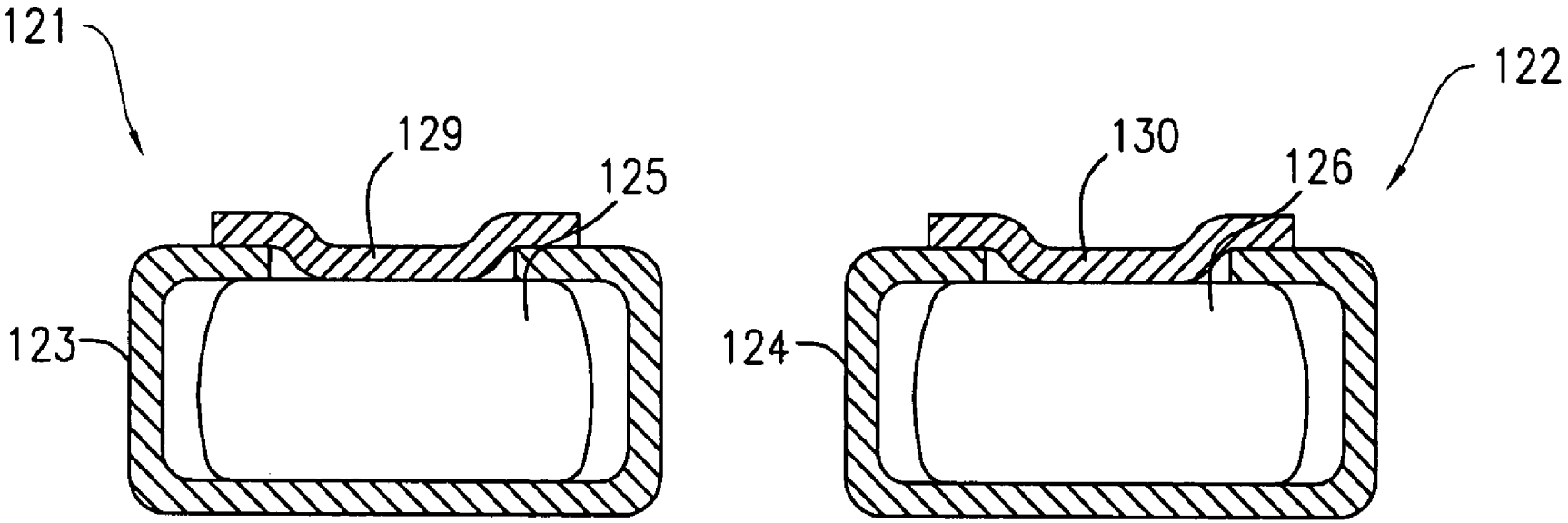
FIG. 8 is a cross section view of a further exemplary embodiment of inserts with caps in accordance with the present invention.

FIG. 8 depicts a further exemplary embodiment of the present invention. The inserts 121, 122 each have a compressible core 125, 126 and a flexible casing 123, 124 for surrounding at least a portion of the compressible core 125, 126, the flexible casing having an open window. The inserts 121, 122 each further include a cap 129, 130. Preferably, the cap is slightly bigger than the size of the window. It can be sealed along the perimeter of the window.

It is also contemplated that the cap does not need to be a separate piece of a flexible material such as a plastic material. A part of a sole, such as midsole or insole, that overlies the insert can be construed as a cap.

The material for the cap is preferably the same as the flexible casing, for example a plastic material or any durable and flexible material. It may be selected from the following exemplary materials bearing in mind that other suitable materials are also contemplated: thermoplastic polyurethane (TPU), polyester-TPU, polyether-TPU, polyester-polyether TPU, polyvinylchloride, polyester, thermoplastic ethyl vinyl acetate, styrene butadiene styrene, TPU blends including natural and synthetic rubbers, and blends or combinations thereof. TPU is the preferred material for the cap.

Figures 9, 10:
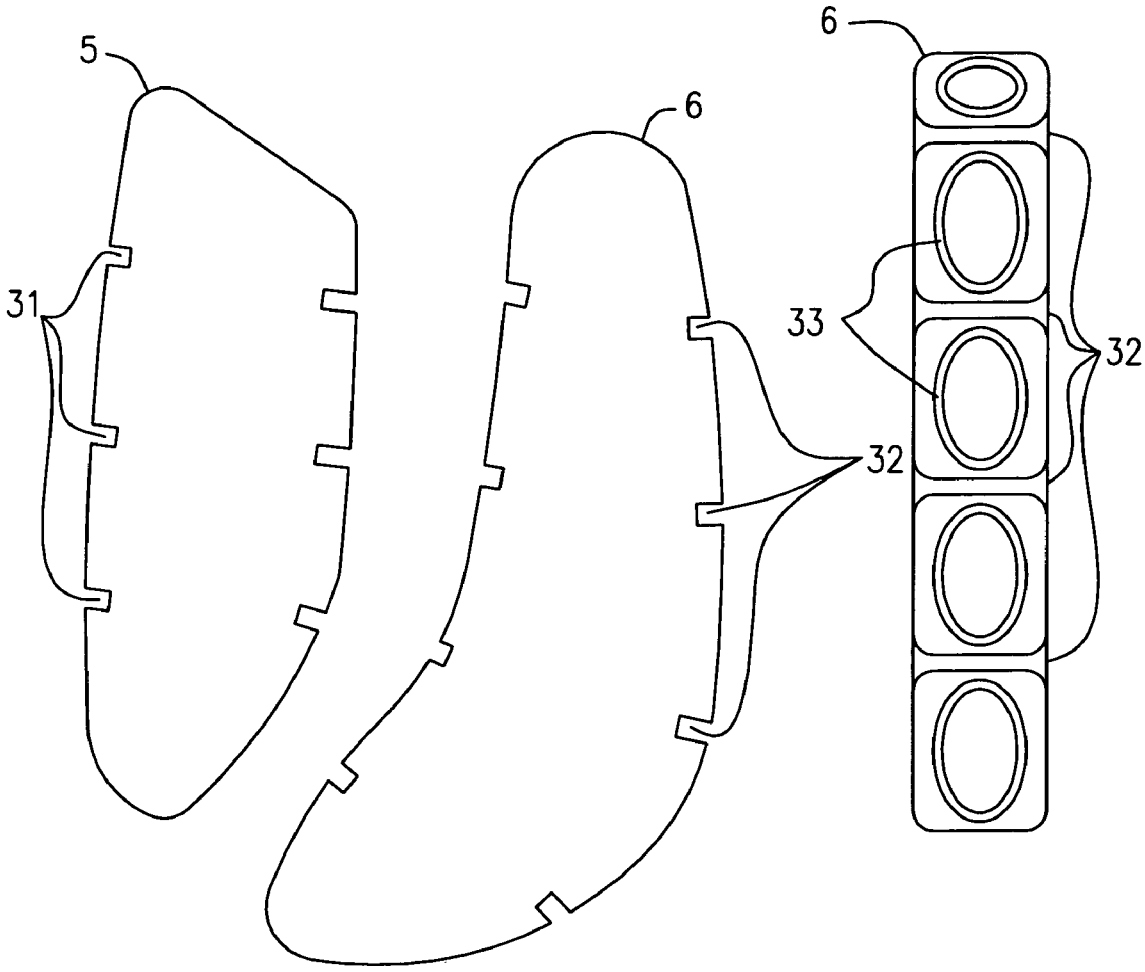
FIG. 9 is a top plan view of the first and second compressible cores contained in the first and second inserts depicted in FIG. 4.
FIG. 10 is a side elevation view of a compressible core.

Referring to FIG. 9, the first and second compressible cores 5, 6 contained in the first and second inserts 1, 2 shown in FIGS. 4-6 include a plurality of ribs 31, 32 on their peripheral surfaces. As shown in FIG. 10, in addition to the ribs, the compressible core may include additional decorative patterns 33 on its peripheral surface. For decorative effect, the compressible core may comprise any decorative patterns, for example circular/oval formations/patterns, positioned on any of its surfaces where appropriate, preferably on the peripheral surface, and most preferably on the outer edges. The decorative patterns, such as printed patterns or formations, may be present on the flexible casing where appropriate. Each of the formations/patterns may be further enhanced with color for visual impact. The compressible core is preferably a single element, for example an isotropic foam. It may have one or more holes, ribs, or other formations/patterns or none at all on its top and bottom surfaces to best suit the effect on the foot of the user and to minimize weight where appropriate.

Figure 11:
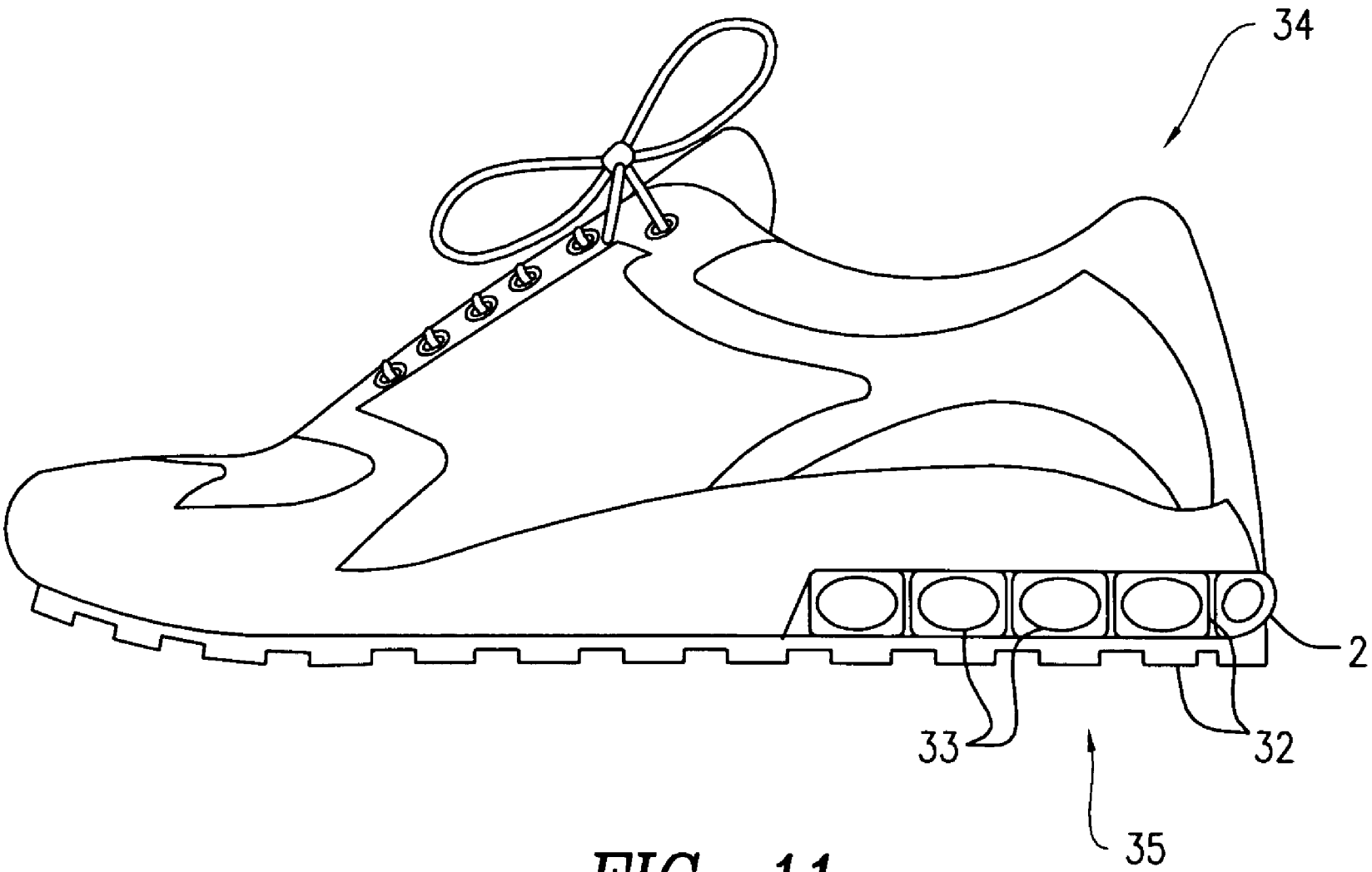
FIG. 11 is a lateral side elevation view of an exemplary article of footwear which incorporates the inserts depicted in FIGS. 4-6.

FIG. 11 depicts a shoe 34 incorporating the inserts shown in FIGS. 4-6 in a heel portion 35 of the sole. The insert 2 is exposed at the lateral side of the shoe 34. The insert 1 is exposed at the medial side of the shoe, which is not shown in the drawings. Due to the presence of an air gap between the flexible casing and the compressive core, it feels soft and pliable when the incorporated inserts are pressed by a thumb from the side of the shoe to test the elasticity of the sole. The insert has a first compressibility at its top or bottom surface and a second compressibility at its peripheral surface. The second compressibility is greater than the first compressibility preferably by at least about 10%, for example about 10-40%, more preferably by at least 20%, for example about 20-50%, and most preferably by at least about 30%, for example about 30-60%.

Furthermore, the decorative ribs 32 and additional decorative patterns 33 on the compressible core are visible through the transparent flexible casing. Therefore, the shoe incorporating the inserts of the present invention not only provide proper cushioning and support for a foot, but is also attractive to customers for providing desirable visual effects and satisfying the thumb test of pliability.

Preferably, at least a portion of the inserts is exposed peripherally from the shoe to touch, for example, along the medial and lateral sides of the shoe. It is also contemplated that the inserts may be exposed at any surface of the shoe including the bottom surface and the rear edge.

Figure 12:
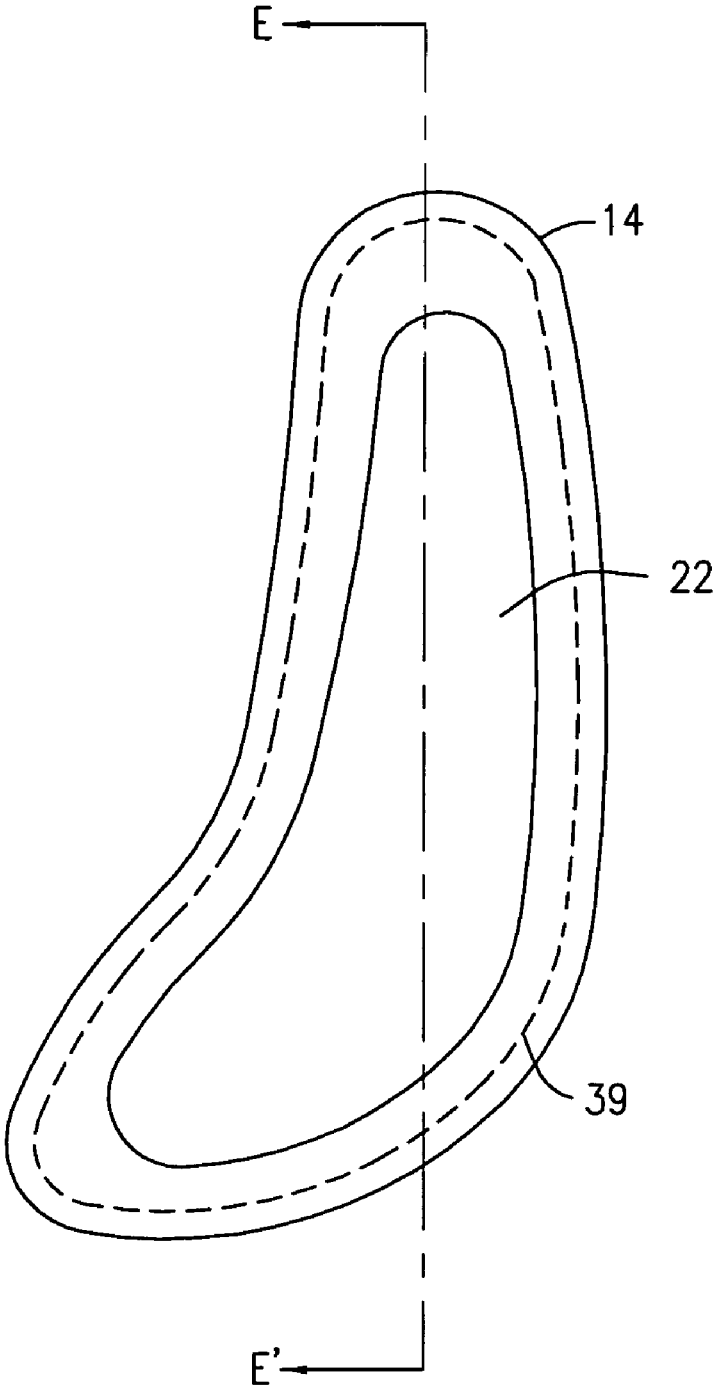
FIG. 12 is a top plan view of a flexible casing for the second insert.
Figure 13:
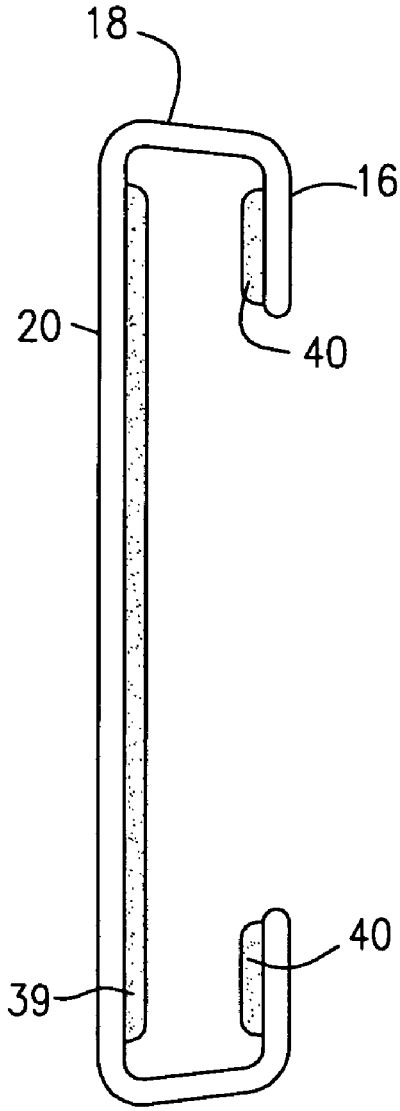
FIG. 13 is a longitudinal section view taken along line E-E' of FIG. 12.

Referring to FIGS. 12 and 13, the insert in accordance with the present invention may be prepared by first forming a flexible casing 14. The flexible casing has a top portion 16, a bottom portion 20 and a peripheral portion 18. The flexible casing has an open window 22 in a portion of the top portion 16. Although the window is formed on the top portion of the flexible casing in the preferred embodiment, it is contemplated that the window may be formed on any portion of the flexible casing, for example, on the bottom or peripheral portion of the flexible casing. The window has a size which is sufficient for insertion of the compressible core into the flexible casing but leaving sufficient material to hold the compressible core. The flexible casing having an open window is preferably formed directly by molding, such as injection molding and blow molding. However, it is also contemplated that the flexible casing may also be formed by first molding a closed flexible casing or a flexible casing having a smaller window and then cutting the flexible casing to form a window of desired dimensions at an appropriate location on the casing.

Then an adhesive is applied to a predetermined area of the inner surface of the formed flexible casing. The flexible casing can be turned inside out to expose the inner surface of the flexible casing for convenient application of the adhesive and then turned back. The predetermined area is at least a portion of the area that will be in contact with the compressible core in the final insert product. In a preferred embodiment as shown in FIG. 13, the adhesive is applied along the periphery of the window 40 and/or at at least a portion of an area corresponding to the bottom surface of the compressible core 39.

Subsequently the compressible core is inserted or shoved into the flexible casing through the window to bring it into contact with the inner surface of the flexible casing such that the compressible core and the flexible casing are bonded through the adhesive. Although the flexible casing is preferably turned back before bringing the compressible core into contact with the inner surface of the flexible casing, it is contemplated that the flexible casing may be turned back after bringing the compressible core into contact with the inner surface of the flexible casing.

To prepare another preferred embodiment of the insert which has a cap for the window, a cap may be die cut from a sheet of plastic material. The cap is then sealed to the bonded flexible casing and compressible core to at least partially cover the window of the flexible casing.

While various embodiments and individual features of the present invention have been illustrated and described, it would be obvious to those skilled in the art that various other changes and modifications can be made without departing from the spirit and scope of the present invention. As will also be apparent to those skilled in the art, various combinations of the embodiments and features taught in the foregoing description are possible and can result in preferred executions of the present invention. Accordingly, it is intended that such changes and modifications fall within the scope of the present invention as defined by the claims appended hereto.

What is claimed is:

1. An insert for an article of footwear, comprising:

a compressible core allowing pressure to be applied thereon by a foot, said compressible core having a top surface, a bottom surface and a peripheral surface; and a flexible casing for substantially surrounding and encircling said top surface, said bottom surface and said peripheral surface of said compressible core, said flexible casing having a top portion, a bottom portion and a peripheral portion, said flexible casing having an open window, said open window having a size which is sufficient for insertion of said compressible core into said flexible casing but small enough to leave sufficient material surrounding said open window and encircling said top surface, said bottom surface and said peripheral surface of said compressible core to confine said compressible core therein, said peripheral portion of said flexible casing being spaced from at least a portion of said peripheral surface of said compressible core, while not interfering with said foot applying pressure to said compressible core.

2. The insert of claim 1, wherein said compressible core comprises a foam material.

3. The insert of claim 1, wherein said compressible core comprises at least one of the following materials and blends and combinations thereof: ethyl vinyl acetate co-polymer, thermo-set polyether and poly-ester urethane, ethyl vinyl acetate co-polymer blends including isoprene rubber, polyolefins, natural and synthetic rubbers.

4. The insert of claim 1, wherein said flexible casing comprises a plastic material.

5. The insert of claim 1, wherein said flexible casing comprises at least one of the following materials and blends and combinations thereof: thermoplastic polyurethane (TPU), polyester-TPU, polyether-TPU, polyester-polyether TPU, polyvinylchloride, polyester, thermoplastic ethyl vinyl acetate, styrene butadiene styrene, TPU blends including natural and synthetic rubbers.

6. The insert of claim 1, wherein said peripheral portion of said flexible casing is spaced from at least a portion of said peripheral surface of said compressible core by about 1 to 8 mm.

7. The insert of claim 1, wherein said peripheral portion of said flexible casing is spaced from at least a portion of said peripheral surface of said compressible core by about 1 to 5 mm.

8. The insert of claim 1, wherein said peripheral portion of said flexible casing is spaced from at least a portion of said peripheral surface of said compressible core by about 1 to 3 mm.

9. The insert of claim 1, wherein said compressible core includes at least one rib or other decorative pattern formed on said peripheral surface for decorative effect.

10. The insert of claim 1, wherein said compressible core and said flexible casing are bonded by an adhesive along the periphery of said open window and/or at least a portion of said bottom surface of said compressible core.

11. The insert of claim 10, wherein a circumferential air gap is formed between said compressible core and said flexible casing.

12. The insert of claim 1, further comprising a cap at least partially covering said open window.

13. The insert of claim 12, wherein said cap comprises a plastic material.

14. The insert of claim 12, wherein said cap comprises at least one of the following materials and blends and combinations thereof: thermoplastic polyurethane (TPU), polyester-TPU, polyether-TPU, polyester-polyether TPU, polyvinylchloride, polyester, thermoplastic ethyl vinyl acetate, styrene butadiene styrene, TPU blends including natural and synthetic rubbers.

15. The insert of claim 1, wherein said open window is located in said top portion of said flexible casing.

16. The insert of claim 1, wherein the insert has a first compressibility at its top or bottom surface and a second compressibility at its peripheral surface, the second compressibility being greater than the first compressibility by at least about 10%.

17. The insert of claim 1, wherein the insert has a first compressibility at its top or bottom surface and a second compressibility at its peripheral surface, the second compressibility being greater than the first compressibility by at least about 20%.

18. The insert of claim 1, wherein the insert has a first compressibility at its top or bottom surface and a second compressibility at its peripheral surface, the second compressibility being greater than the first compressibility by at least about 30%.

19. The insert of claim 1, wherein the insert has a first compressibility at its top or bottom surface and a second compressibility at its peripheral surface, the second compressibility being greater than the first compressibility by about 10-40%.

20. An article of footwear, comprising a sole, said sole having a portion formed to receive an insert; and an insert mounted in said portion formed to receive an insert, said insert comprising:

a compressible core allowing pressure to be applied thereon by a foot, said compressible core having a top surface, a bottom surface and a peripheral surface; and a flexible casing for substantially surrounding and encircling said top surface, said bottom surface and said peripheral surface of said compressible core, said flexible casing having a top portion, a bottom portion and a peripheral portion, said flexible casing having an open window, said open window having a size which is sufficient for insertion of said compressible core into said flexible casing but small enough to leave sufficient material surrounding said open window and encircling said top surface, said bottom surface and said peripheral surface of said compressible core to confine said compressible core therein, said peripheral portion of said flexible casing being spaced from at least a portion of said peripheral surface of said compressible core, while not interfering with said foot applying pressure to said compressible core.

21. The article of footwear of claim 20, wherein said compressible core comprises a foam material.

22. The article of footwear of claim 20, wherein said compressible core comprises at least one of the following materials and blends and combinations thereof: ethyl vinyl acetate co-polymer, thermo-set polyether and poly-ester urethane, ethyl vinyl acetate co-polymer blends including isoprene rubber, poly-olefins, natural and synthetic rubbers.

23. The article of footwear of claim 20, wherein said flexible casing comprises a plastic material.

24. The article of footwear of claim 20, wherein said flexible casing comprises at least one of the following materials and blends and combinations thereof: thermoplastic polyurethane (TPU), polyester-TPU, polyether-TPU, polyester-polyether TPU, polyvinylchloride, polyester, thermoplastic ethyl vinyl acetate, styrene butadiene styrene, TPU blends including natural and synthetic rubbers.

25. The article of footwear of claim 20, wherein said peripheral portion of said flexible casing is spaced from at least a portion of said peripheral surface of said compressible core by about 1 to 8 mm.

26. The article of footwear of claim 20, wherein said peripheral portion of said flexible casing is spaced from at least a portion of said peripheral surface of said compressible core by about 1 to 5 mm.

27. The article of footwear of claim 20, wherein said peripheral portion of said flexible casing is spaced from at least a portion of said peripheral surface of said compressible core by about 1 to 3 mm.

28. The article of footwear of claim 20, wherein said compressible core includes at least one rib or other decorative pattern formed on said peripheral surface for decorative effect.

29. The article of footwear of claim 20, wherein said compressible core and said flexible casing are bonded by an adhesive along the periphery of said open window and/or at least a portion of said bottom surface of said compressible core.

30. The article of footwear of claim 29, wherein a circumferential air gap is formed between said compressible core and said flexible casing.

31. The article of footwear of claim 20, further comprising a cap at least partially covering said open window.

32. The article of footwear of claim 31, wherein said cap comprises a plastic material.

33. The article of footwear of claim 31, wherein said cap comprises at least one of the following materials and blends and combinations thereof: thermoplastic polyurethane (TPU), polyester-TPU, polyether-TPU, polyester-polyether TPU, polyvinylchloride, polyester, thermoplastic ethyl vinyl acetate, styrene butadiene styrene, TPU blends including natural and synthetic rubbers.

34. The article of footwear of claim 20, wherein said open window is located in said top portion of said flexible casing.

35. The article of footwear of claim 20, wherein at least a portion of said insert is exposed from said article of footwear.

36. The article of footwear of claim 35, wherein said insert is exposed peripherally.

37. The article of footwear of claim 20, which comprises a pair of inserts positioned in a heel portion of said sole.

38. The article of footwear of claim 37, wherein one insert is of trapezoidal shape and the other insert is of kidney-like shape.

39. The article of footwear of claim 20, wherein the insert has a first compressibility at its top or bottom surface and a second compressibility at its peripheral surface, the second compressibility being greater than the first compressibility by at least about 10%.

40. The article of footwear of claim 20, wherein the insert has a first compressibility at its top or bottom surface and a second compressibility at its peripheral surface, the second compressibility being greater than the first compressibility by at least about 20%.

41. The article of footwear of claim 20, wherein the insert has a first compressibility at its top or bottom surface and a second compressibility at its peripheral surface, the second compressibility being greater than the first compressibility by at least about 30%.

42. The article of footwear of claim 20, wherein the insert has a first compressibility at its top or bottom surface and a second compressibility at its peripheral surface, the second compressibility being greater than the first compressibility by about 10-40%.

* * * * *